US006083017A

United States Patent [19]

Matsumura

[11] Patent Number: 6,083,017

[45] **Date of Patent: *Jul. 4, 2000**

[54] CONNECTOR ENGAGING STRUCTURE

[75] Inventor: Norio Matsumura, Shizuoka, Japan

[73] Assignee: Yazaki Corporation, Tokyo, Japan

[ * ] Notice: This patent is subject to a terminal disclaimer.

[21] Appl. No.: 09/037,991

[22] Filed: Mar. 11, 1998

[30] Foreign Application Priority Data

Mar. 12, 1997 [JP] Japan ..... 9-057962

[51] Int. Cl.[7] ..... H01R 13/62

[52] U.S. Cl. ..... 439/157; 439/347

[58] Field of Search ..... 439/157, 152, 439/347, 160, 310

[56] References Cited

U.S. PATENT DOCUMENTS 5,785,540 7/1998 Jaklin ..... 439/157
5,904,583 5/1999 Katsuma et al. ..... 439/157
5,915,982 6/1999 Kashiyama et al. ..... 439/157

FOREIGN PATENT DOCUMENTS 2-123681 5/1990 Japan .
4-319271 11/1992 Japan .

*Primary Examiner*—Gary F. Paumen
*Assistant Examiner*—Tho D. Ta
*Attorney, Agent, or Firm*—Morgan, Lewis & Bockius LLP

[57] ABSTRACT

In a connector engaging structure in which slide members (13) are provided for one (20) of female and male connectors (20 and 30) which slide in "go" and "return" modes, guide pins (34) provided on the other connector (30) are engaged with guide grooves (14) formed in the slide members (13), when the slide members (13) move in a "go" mode, the other connector (30) is pulled in the one connector (20) so that the two connectors are engaged with each other, and when the slide members (13) move in a "return" mode, the two connectors (20 and 30) are disengaged from each other;temporarily locking means adapted to lock the guide pins (34) temporarily are provided for lead-in grooves **(14*a*) of the guide grooves (14) which are inlets for the guide pins (34)**.

4 Claims, 4 Drawing Sheets

CONNECTOR ENGAGING STRUCTURE

BACKGROUND OF THE INVENTION

This invention relates to a connector engaging structure in which a slide member is slid in a "go" and "return" mode with an operation lever to move a multi-pole female connector and a multi-pole male connector into and out of engagement with each other through a guide pipe engaged with a sloped guide groove of the slide member.

An example of a conventional connector engaging structure of this type is as shown in FIG. 1, being disclosed by Japanese Patent Unexamined Publication No. 319271/1992. The connector engaging structure comprises: a slide member 1 in which a pair of male connectors 2 and 2 is fixedly inserted, and has a pair of pins 3 and 3 extended from each of the upper and lower walls; a female connector 4 into which the slide member 1 is inserted, the female connector 4 having a pair of substantially rectangular openings 5 and 5 formed in the upper and lower portions of each of the right and left side walls thereof; and a substantially U-shaped operating member 6 having an upper wall and a lower wall which are inserted into the female connector 4 through the pair of openings 5 and 5 in one of the right and left side walls thereof. The upper and lower walls have two pair of inclined guide grooves 7, respectively, which are engaged with the pins 3 of the slide member 1, respectively. When the operating member is slid in "go" and "return" modes, the multi-pole connectors of the male connectors 2 and those of the female connectors are moved into and out of engaged with each other. A structure similar to the above-described connector engaging structure has been disclosed by Japanese Patent Unexamined Publication No. 123681/1990.

In the above-described conventional connector engaging structure, in order to prevent the erroneous operation of the operating member and to perform a snappy engaging operation with ease, it is necessary to provide temporary locking mechanisms which are operated before the operation of the operating member 6. However, if the temporary locking mechanisms are provided on the sides of the openings of the connectors 2 and 4, then the openings are enlarged, or the connector body is unavoidably make bulky. In order to prevent the connector from become bulky as a whole, the thickness of parts of the connector may be decreased, or cuts and holes may be formed therein. However, this method suffers from a difficulty that the connector itself is lowered in rigidity.

SUMMARY OF THE INVENTION

Accordingly, an object of the invention is to eliminate the above-described difficulties accompanying a conventional connector engaging structure. More specifically, an object of the invention is to provide a connector engaging structure in which, without the increase in size of the connector and the decrease in rigidity thereof, before the operation of the operating lever, one connector is temporarily engaged with the other connector, so that the erroneous operation of the operating lever is positively prevented, and the two connectors are readily engaged with each other.

The above-mentioned object can be achieved by a connector engaging structure, according to the present invention, in which slide members are provided for one of female and male connectors which slide in "go" and "return" modes, guide pins provided on the other connector are engaged with guide grooves formed in the slide member, when the slide members move in a "go" mode, the other connector is pulled in the one connector so that the two connectors are engaged with each other, and when the slide members moved in a "return" mode, the two connectors are disengaged from each other; in which, according to the invention, temporarily locking means adapted to lock the guide pins temporarily are provided for lead-in grooves of the guide grooves which are inlets for the guide pins.

With the structure, it is unnecessary to increase the size of the connector, and the connector is not lowered in rigidity. And before the operation of the operating lever, one connector is temporarily locked to the other connector to positively prevent the erroneous operation of the operating lever, whereby the multi-pole male and female connectors are engaged with each other with ease.

In the above-mentioned construction of the connector engaging structure according to the present invention, preferably, each of the temporarily locking means comprises: a flexible protrusion provided in parallel with the lead-in groove of the respective guide groove; and a pair of cuts provided on both sides of the flexible protrusion.

In the structure, the locking means are simple. Before the operation of the operating lever, the guide pins of the other connectors are temporarily locked owing to the flexible protrusions of the slide members and the lead-in grooves of the guide grooves, whereby the erroneous operation of the operating lever is positively prevented, and the multi-pole male and female connectors are engaged with each other with ease.

In addition, in the above-mentioned construction of the connector engaging structure according to the present invention, preferably, a pair of the slide members are arranged in such a manner that the slide members are on both sides of the one connector, and the slide members have guide grooves which are inclined a predetermined angle with respect to the direction of movement of the slide members and inclined in the opposite directions.

In the structure, owing to the division of force which is due to the lever ratio of the operating lever and the angle of inclination of the inclined grooves of the guide grooves of the pair of slide members, the multi-pole male and female connectors can be engaged with each other with a small operating force.

DETAILED DESCRIPTION OF THE PREFERRED EMBODIMENTS

A preferred embodiment of the invention will be described with the accompanying drawings.

Figure 1:
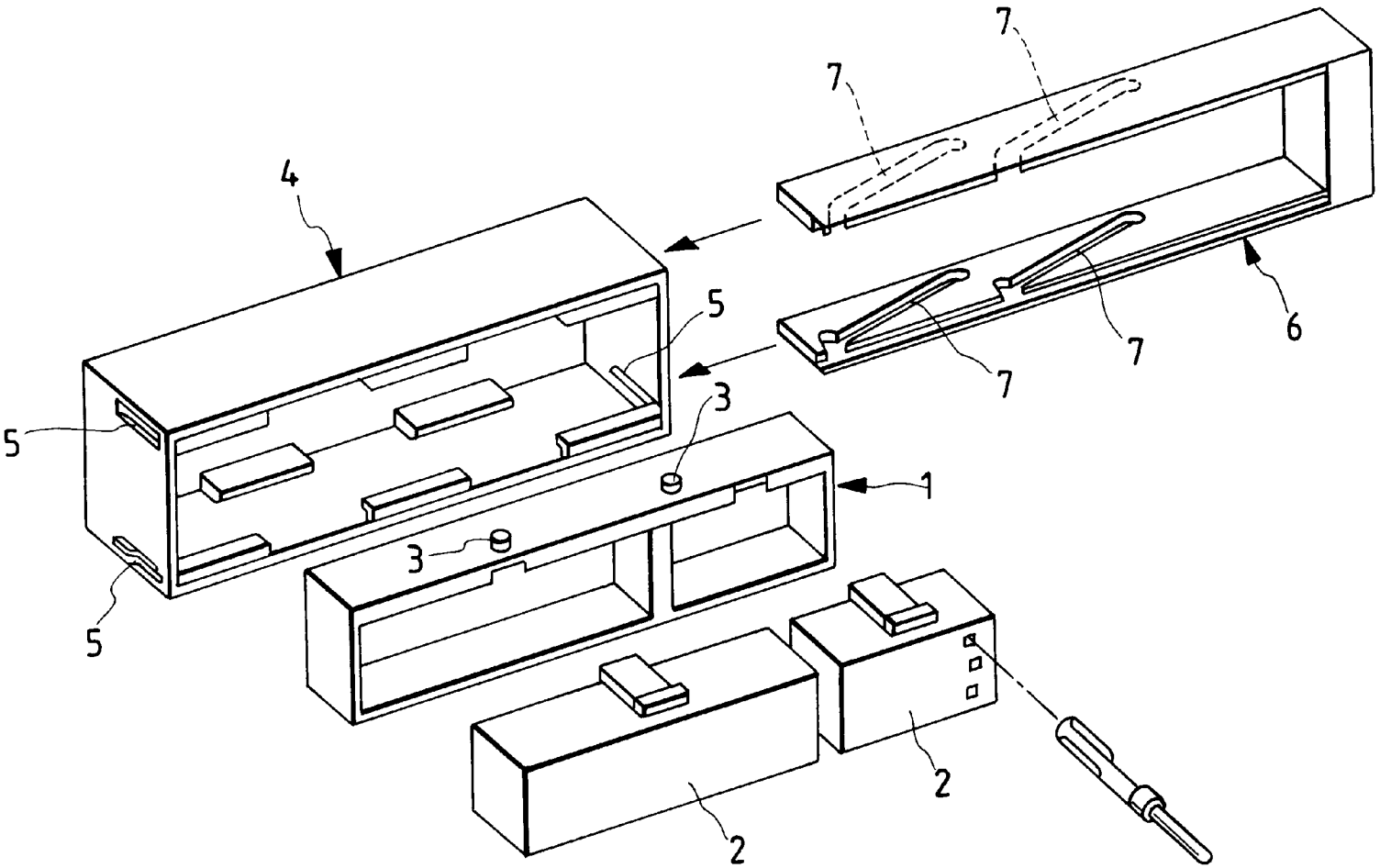
FIG. 1 PRIOR ART
FIG. 1 is an exploded perspective view of a conventional connector engaging structure.
Figure 2:
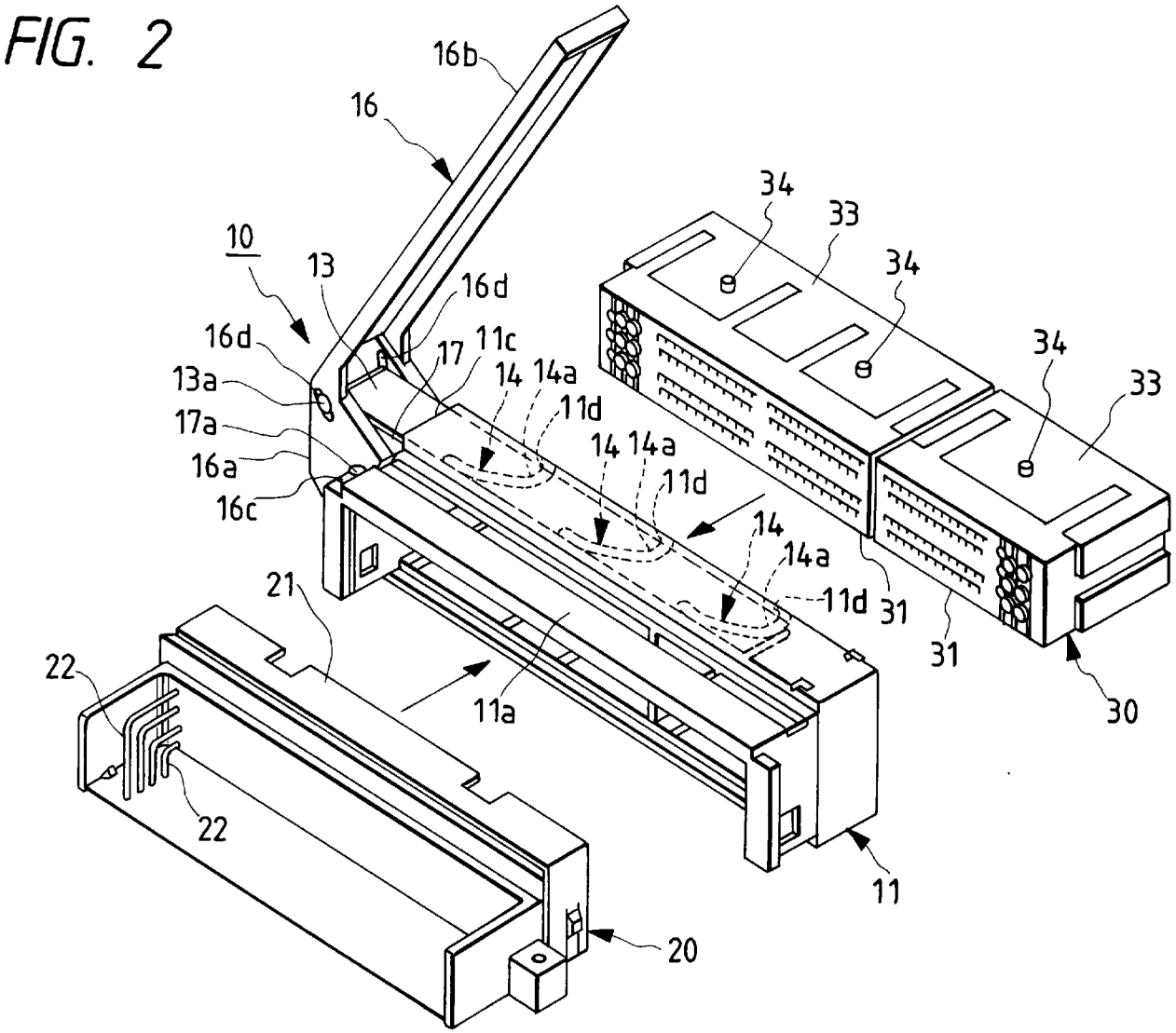
FIG. 2 is a perspective view of a connector engaging structure, a preferred embodiment of the invention, from which the male and female connector thereof are separated.

FIG. 2 is a perspective view of a connector engaging structure of the invention in which male and female connectors are disengaged from each other. The connector engaging structure comprises: a hood assembly 10; and male and female connectors 20 and 30. The hood assembly 10 comprises a synthetic resin hood 11 which has a rear portion 11*a* in which the female connector (one connector) is fixedly fitted, and a front opening 11*b* into which the male connector (the other connector) are inserted, the hood 11 having upper and lower slide grooves 12 and 12 formed in the upper and lower walls of the front portion thereof, and a pair of upper and lower inserting inlets 11*c* and 11*c* which are formed in upper and lower portions of one side wall of the hood; a pair of slide members 13 and 13 of synthetic resin which are inserted through the upper and lower inserting inlets 11*c* and 11*c* into the upper and lower slide grooves 12 and 12, thus being slide in "go" and "return" modes.

Figure 3:
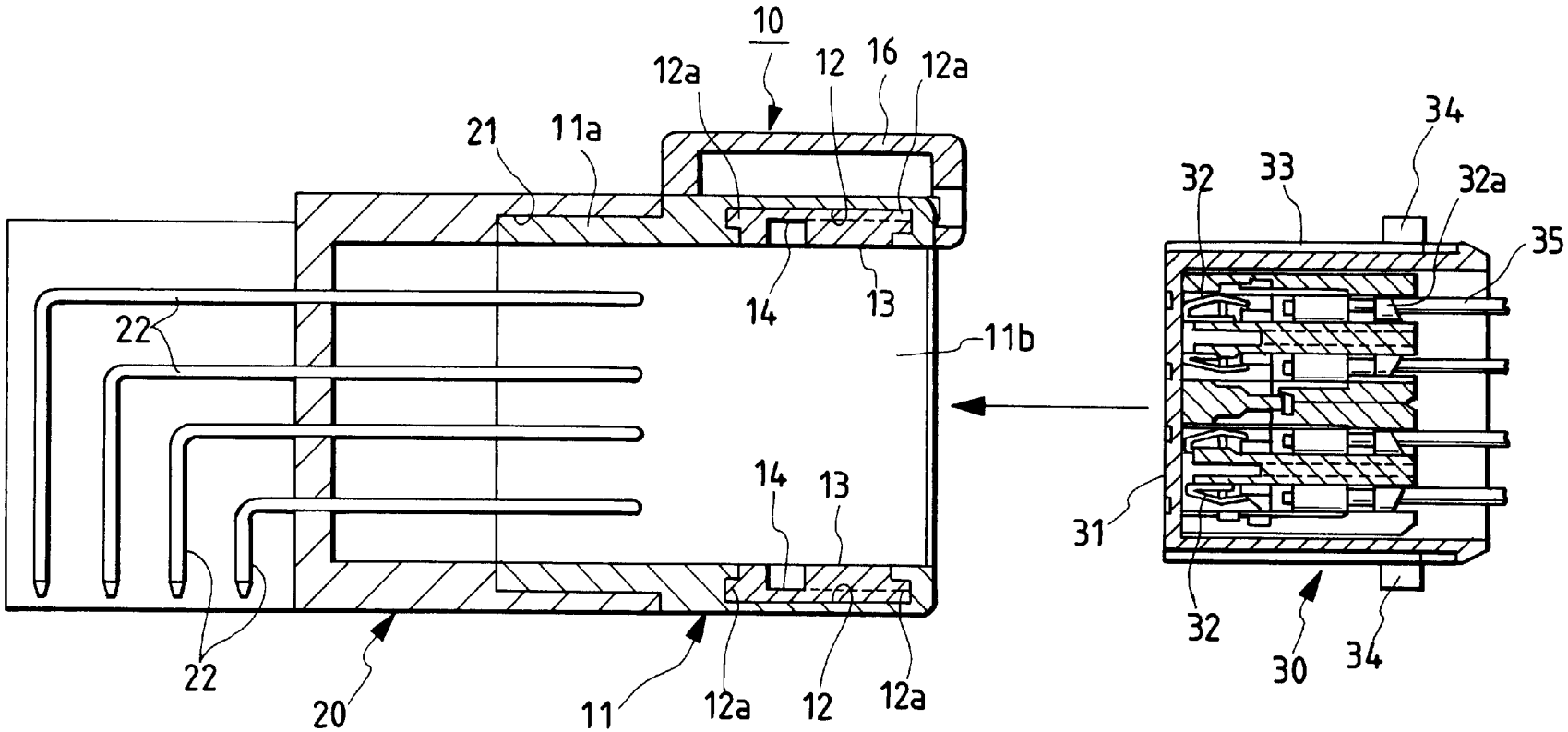
FIG. 3 is a sectional view of the male and female connectors which are going to be engaged with each other; and The part (A) of FIG. 4 is an explanatory diagram of slide members as viewed from a guide groove side which is provided for the female connector, and the part (B) of FIG. 4 is an enlarged explanatory diagram of the part "K" of the part (A) of FIG. 4.

As shown in FIG. 3, the pair of slide grooves 12 and 12, which are slide sections provided in the upper and lower wall surface of the front portion of the hood 11, have a pair of steps 12*a* and 12*a* adapted to hold the thick portions of the pair of slide members 13 and 13. The slide members slide in a "go" and "return" mode, in the opposite directions along the slide grooves 12 and 12. As shown in FIG. 2, the upper and lower slide members 13 and 13 of the hood 11 have cuts 11*d* at the positions which confront with the lead-in grooves 14*a* of guide grooves 14 (described later).

The surfaces of the pair of slide members 13 and 13 which are confronted with each other, have three guide grooves 14 which are inclined forming a predetermined angle with a slide member insertion direction.

Figure 4A:
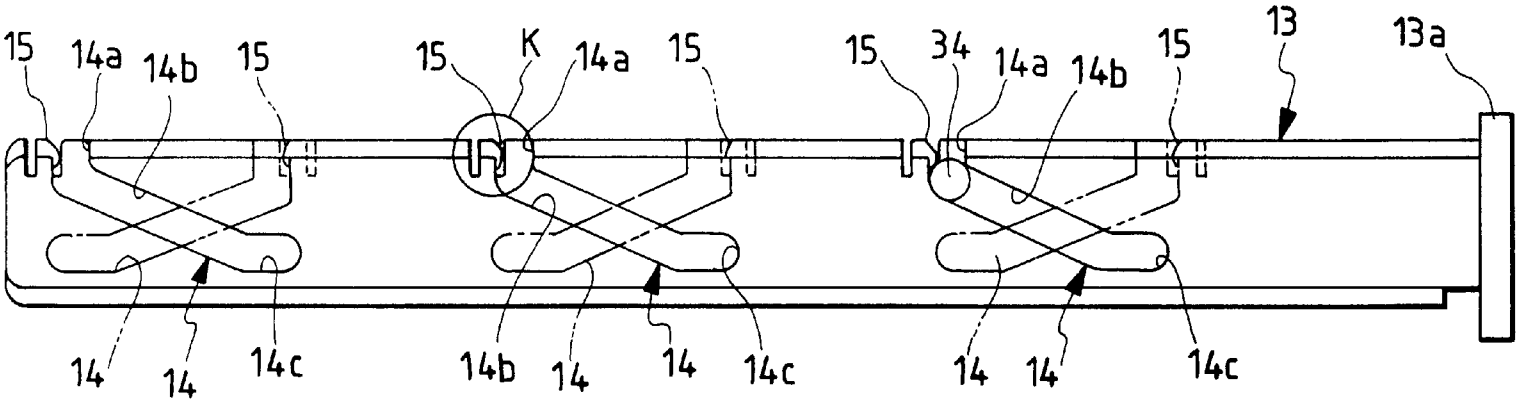
Figure 4B:
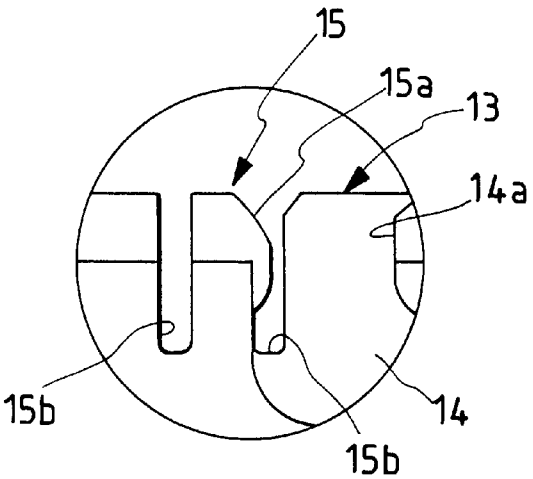

As indicated by the solid lines and the one-dot chain lines in the part (A) of FIG. 4, the guide grooves 14 of the upper slide member 13 and those of the lower slide member 13 are opposite in the direction of inclination. Each of the guide grooves 14 is made up of: a lead-in groove 14*a* which opens in one side edge (the upper edge in FIG. 4), and extends substantially perpendicular to the side edge; an inclined groove 14*b* extended from the lead-in groove 14*a*; and an end groove 14*c* which is extended from the inclined groove 14*b* in such a manner that it is in parallel with the longitudinal direction of the slide member 13. As shown in the part (B) of FIG. 4, on one side of the lead-in groove 14*a* of the guide groove 14 which serves an inlet for a guide pin 34 (described later), temporarily locking means 15 for temporarily locking the guide pin 34 is provided. The temporarily locking means 15 is made up of: a flexible protrusion 15*a* which is protruded in such a manner that it is in parallel with the lead-in groove 14*a* of the guide groove 14; and a pair of cuts 15*b* and 15*b* provided on both sides of the flexible protrusion 15*a*.

As shown in FIG. 2, an operating lever 16 adapted to slide the pair of slide members 13 and 13 in the opposite directions in a "go" and "return" mode comprises: a U-shaped swing portion 16*a*; and a lever 16*b* extended from the swing portion 16*a*. The swing portion 16*a* has swing center holes 16*c* and 16*c* on both sides. The swing center holes 16*c* and 16*c* are engaged with swing center shafts 17*a* and 17*a* on both sides of a lever mounting portion 17 which is formed between a pair of upper and lower inserting inlets 11*c* and 11*c* in one side wall of the hood 11. In addition, a pair of elongated holes 16*d* and 16*d* are formed in such a manner that they are located above and below each of the swing center holes 16*c* of the swing portion 16*a*. The cylindrical mounting protrusions 13*a* of the upper and lower slide members 13 and 13 are inserted into the elongated holes 16*d* thus formed. Therefore, as the operating lever 16 is moved up and down, the pair of upper and lower slide members 13 and 13 are slid in the opposite direction in "go" and "return" modes.

As shown in FIG. 3, the rear end portion 11*a* of the hood 11 of hood assembly 10 is fixedly fitted in the front opening 21 of the female connector 20, and a plurality of pin terminals 22 are extended from the opening 21 towards the inside of the opening of the rear end portion 11*a* of the hood 11. And, a pair of connector bodies 31 and 31 of the male connector 30 are inserted into the front opening 11*b* of the hood 11 of the hood assembly 10 in such a manner that they are perpendicular to the direction of movement of the slide members 13. In the connector bodies 31 of the male connector 30, a plurality of press terminals 32 are arranged into which the pin terminals 22 are inserted to electrically connect the male and female terminals 20 and 30 to each other. Three guide pins 34 are protruded from each of the upper and lower surfaces of covers 33 which cover the connector bodies 31 of the male connector 30. The guide pins 34 are set in alignment with the cuts lid of the hood 11 and are inserted into the guide grooves 14 of the slide members 13 when the male and female connectors 20 and 30 are engaged with each other. A wire 35 is connected to the press portion 32*a* of each of the press terminals 32 by crimping.

In the above-described connector engaging structure, as shown in FIG. 3, with the hood assembly 10 coupled to the female connector 20, the male connector 30 is inserted into the female connector 20, and the guide pins 34 of the male connector 30 are engaged through the cuts 11*d* of the hood 11 with the lead-in grooves 14*a* of the guide grooves 14 of the slide members 13. When, under this condition, the operating lever 16 is moved downwardly, the slide members 13 are slid in the slide grooves 12 of the hood 11 in "go" and "return" direction. Hence, the guide pins 34 are moved from the lead-in grooves 14*a* of the guide grooves 14 through the inclined grooves 14*b* to the end grooves 14*c*, so that they are engaged with the front opening (the hood) 21 of the female connector 20; that is, the male and female connectors 20 and 30 are engaged with each other. When, on the other hand, the operating lever 16 is moved upwardly, the slide members 13 are slid in the slide grooves 12 of the hood 11 in a "return" direction, so that the guide pins 34 are moved from the end grooves 14*c* of the guide grooves 14 through the inclined grooves 14*b* to the lead-in grooves 14*a*, whereby the male connector 30 is moved away from the front opening (the hood) 21 of the female connector 20; that is, the male and female connectors 20 and 30 are disengaged from each other.

The temporarily locking means 15 for temporarily locking the guide pins 34 are provided in the lead-in grooves 14*a* of the guide grooves 14 of the slide members 13. Hence, when the guide pins 34 of the male connector 20 are inserted through the cuts 11*d* of the hood 11 into the lead-in grooves 14*a* of the guide grooves 14 of the slide members 13, before the operation of the operating lever 16 the male connector 30 is temporarily lock to the female connector 20, whereby the erroneous operation of the operating lever 16 is positively prevented. And in this case, it is unnecessary to increase the size of the female connector 20, and the hood 11 itself is not lowered in rigidity. In addition, the multi-pole male and female connectors 20 and 30 can be engaged with each other with ease. The temporarily locking means 15 are simple in construction. That is, each of the temporarily locking means comprises: the flexible protrusion 15*a* which is extended in parallel with the lead-in groove 14*a* of the guide groove 14 of the respective slide member 13; and a pair of cuts 15*b* and 15*b* provided on both sides of the protrusion 15*a*. That is, the simple temporarily locking means are provided on the slide members 13, whereby the connector is not bulky, and the opening is not lowered in rigidity. Hence, before the operation of the operating lever, the guide pins 34 of the male connector 30 are temporarily locked between the flexible protrusions 15*a* of the slide members 13 and the lead-in grooves 14*a* of the guide grooves 14, which positively prevents the erroneous operation of the operating lever 16, and the snappy engaging operation of the multi-pole male and female connectors 20 and 30 can be achieved.

When the male connector 30 is engaged with the front opening 21 of the female connector 20, the pair of upper and lower slide members 13 and 13 are slid in the opposite directions (in "go" and "return" modes), and therefore the upper and lower guide pins of the male connector 30 are guided by the guide grooves 14 of the slide members 13 which are inclined in the opposite directions. Hence, the forces which the guide grooves 14 apply to the guide pins 34 are in the opposite directions, whereby the inclination or play of the male connector 30 having the guide pins 34 with respect to the female connector 20 is positively prevented, and the male and female connectors are positively engaged with or disengaged from each other. Furthermore, owing to the division of force which is due to the lever ratio of the operating lever 16 and the angle of inclination of the inclined grooves 14*b* of the guide grooves 14 of the pair of slide members 13 and 13, the multi-pole male and female connectors 20 and 30 can be engaged with or disengaged from each other with a small operating force.

In the above-described embodiment, the slide members having the guide grooves are provided on the female connector side, while the guide pins engaged with the guide grooves are provided on the male connector side; however, the guide pin may be on the female connector side with the slide members provided on the male connector side.

As was described above, in the connector engaging structure of the present invention, the temporarily locking means adapted to lock the guide pins temporarily are provided for the lead-in grooves of the guide grooves which are inlets for the guide pins. With the structure, it is unnecessary to increase the size of the connector, and the connector is not lowered in rigidity. And before the operation of the operating lever, one connector is temporarily locked to the other connector to positively prevent the erroneous operation of the operating lever, whereby the multi-pole male and female connectors are engaged with each other with ease.

In the connector engaging structure of the present invention, each of the temporarily locking means comprises: the flexible protrusion provided in parallel with the lead-in groove of the respective guide groove; and a pair of cuts provided on both sides of the flexible protrusion. In the structure, the locking means are simple. Before the operation of the operating lever, the guide pins of the other connectors are temporarily locked owing to the flexible protrusions of the slide members and the lead-in grooves of the guide grooves, whereby the erroneous operation of the operating lever is positively prevented, and the multi-pole male and female connectors are engaged with each other with ease.

In the connector engaging structure of the present invention, a pair of the slide members are arranged in such a manner that the slide members are on both sides of the one connector, and the slide members have the guide grooves which are inclined a predetermined angle with respect to the direction of movement of the slide members and inclined in the opposite directions.

In the structure, owing to the division of force which is due to the lever ratio of the operating lever and the angle of inclination of the inclined grooves of the guide grooves of the pair of slide members, the multi-pole male and female connectors can be engaged with and disengaged from each other with a small operating force.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector engaging structure comprising:

slide members provided for one of female and male connectors which slide in "go" and "return" modes, guide pins provided on the other connector and engaged with guide grooves formed in said slide member, in such a manner that when said slide members move in said "go" mode, said other connector is pulled in said one connector so that said two connectors are engaged with each other, and when said slide members move in said "return" mode, said two connectors are disengaged from each other; and temporarily locking means provided on said slide members in lead-in grooves of said guide grooves which are inlets for said guide pins, said temporarily locking means temporarily locking said guide pins in position relative to said guide grooves.

2. A connector engaging structure as claimed in claim 1, wherein a pair of said slide members are arranged in such a manner that said slide members are on both sides of said one connector, and said guide grooves being inclined at a predetermined angle with respect to a direction of movement of said slide members and inclined in opposite directions.

3. The connector engaging structure as claimed in claim 1, wherein each of said temporarily locking means comprises:

a flexible protrusion provided in parallel with said lead-in groove of the respective guide groove; and a pair of cuts provided on both sides of said flexible protrusion.

4. A connector engaging structure as claimed in claim 3, wherein a pair of said slide members are arranged in such a manner that said slide members are on both sides of said one connector, and said guide grooves being inclined at a predetermined angle with respect to a direction of movement of said slide members and inclined in opposite directions.

* * * * *